US006108867A

United States Patent [19]

Nagashima

[11] Patent Number: 6,108,867

[45] Date of Patent: Aug. 29, 2000

[54] HANDLING DEVICE FOR POWER WORKING MACHINE

[75] Inventor: Akira Nagashima, Kanagawa, Japan

[73] Assignee: Kioritz Corporation, Tokyo, Japan

[21] Appl. No.: 09/074,340

[22] Filed: May 7, 1998

[30] Foreign Application Priority Data

May 14, 1997 [JP] Japan ..... 9-124284
Oct. 16, 1997 [JP] Japan ..... 9-283282

[51] Int. Cl.[7] ..... A47B 95/02; E05B 1/00

[52] U.S. Cl. ..... 16/110.1; 16/430; 16/900; 30/122

[58] Field of Search ..... 16/110.1, 430, 16/445, 900, 426; 173/170; 30/519, 381–383, 122, 276

[56] References Cited

U.S. PATENT DOCUMENTS 4,382,333 5/1983 Nagashima et al. ..... 30/381
4,785,540 11/1988 Arvidsson ..... 30/381
5,065,476 11/1991 Dohse et al. ..... 16/114
5,101,567 4/1992 Cool ..... 30/382
5,466,183 11/1995 Kirn et al. ..... 30/518
5,725,422 3/1998 Leweck ..... 16/422
5,813,123 9/1998 Wieland et al. ..... 30/381

FOREIGN PATENT DOCUMENTS 195 32 299 6/1997 Germany .

*Primary Examiner*—Chuck Y. Mah
*Attorney, Agent, or Firm*—Baker Botts L.L.P.

[57] ABSTRACT

A handling device for a power working machine provided rotatably with a rear handle portion, wherein the handling device is constructed such that the rotation of the rear handle portion is always locked whenever the throttle lever for actuating control member of the prime mover is manipulated, and such that, when the rotation of the rear handle portion is once engaged and fixed, a locking mechanism is actuated to lock the rotation of the rear handle portion. The handling device comprises a throttle lever, attached rotatably to the device and designed to actuate a control member of the prime mover, and a handle-engaging member, designed to be engaged with a mount base of the handling device so as to lock the rotational position of the handling device relative to the mount base.

8 Claims, 9 Drawing Sheets

HANDLING DEVICE FOR POWER WORKING MACHINE

BACKGROUND OF THE INVENTION

1. Field of the Invention

This invention relates to a handling device for a power working machine, and in particular to a safety operation system of a handling device which is rotatably attached to the rear portion of a portable type power working machine such as a hedge trimmer.

2. The Prior Art

A portable-type power working machine, such as a hedge trimmer, is generally constituted by a prime mover case having a prime mover, such as an internal combustion engine or an electric motor, a mount base portion enclosing a transmission case having a power transmission device, such as gears, to be actuated by the prime mover, a working portion comprising clipper blades to be actuated via the aforementioned power transmission device by the prime mover, and a handling portion attached to the prime mover case or the mount base portion. This handling portion is constituted, for the convenience of manipulation thereof, by a front handle portion and a rear handle portion.

The rear handle portion is provided, for example, with a throttle lever for manipulating a throttle valve, for controlling an internal combustion engine employed as a prime mover, or with a power switch, for an electric motor. Moreover, the rear handle portion is rotatably mounted on the mount base so as to enable it to be effectively and easily operated against an object to be worked, and at the same time, adapted to be fastened at any suitable position with a fastening member.

Thus, in the operation of the foregoing portable-type power working machine, the rear handle portion is at first suitably rotated relative to the mount base, by taking the arrangement or position of the object to be worked into consideration, and then fastened at a desired position with the fastening member. Then, while the front handle portion is being held by one hand and the rear handle portion (fixed in a suitably rotated position) is being held by the other hand, the operation with the working portion such as clipper blades is performed while controlling the movement of the internal combustion engine by manipulating the control lever, such as the throttle lever, by the other hand holding the rear handle portion.

However, since the rear handle portion is rotatably mounted on the aforementioned portable-type power working machine, if the throttle lever is inadvertently manipulated while the rear handle portion is left in a rotatable condition, the working portion such as the clipper blades may be unexpectedly actuated due to an increase in the output of the engine. At the same time, the mount base to which the working portion is fixed may be caused to rotate relative to the rear handle portion, thus inviting an unexpected accident.

In an attempt to overcome this problem, there has been proposed a portable-type power working machine in U.S. Pat. No. 5,065,476, wherein the throttle lever is made impossible to manipulate as long as the rear handle is left rotatable. The portable-type power working machine proposed in this specification is provided with a releasable lock means comprising a projected portion-attached rotating lever and a recessed portion to be engaged with the projected portion. If the rear handle is desired to be rotated, the rotating lever is operated so as to disengage the projected portion from the recessed portion at first, and then the rear handle is rotated while keeping the projected portion in a disengaged state. Therefore, the handling of the rear handle portion is rather troublesome. Moreover, since the rotating lever is disposed below the rear handle portion due to the configurational restriction of the members of the rear handle portion as a whole, and, at the same time, since the rear handle portion is designed to be rotated while pushing the rotating lever, the rear handle portion is rendered difficult to manipulate.

BRIEF SUMMARY OF THE INVENTION

The present invention has been made to cope with the aforementioned conventional problems. It is therefore an object of the present invention to provide a handling device for a power working machine having a rotatable rear handle portion, wherein the handling device is constructed such that the rear handle portion is always locked against rotation whenever the control lever for actuating the control member of the prime mover is manipulated, and wherein, when the rotation of the rear handle is once engaged and fixed, a locking mechanism is actuated to lock the rotation of rear handle portion.

With a view to realizing the aforementioned object, the invention provides a handling device for a power working machine provided with a prime mover, a mount base and a working portion, which is characterized in that the handling device attached rotatably to the mount base comprises a control lever designed to actuate a control member of the prime mover, a handle-engaging member is designed to be engaged with the mount base so as to lock the rotation of the handling device, and the handle-engaging member is designed to swing according to a rotating movement of the control lever so as to be engaged with and locked to the mount base.

One preferred embodiment of the handling device according to the invention is constructed as follows. The control lever comprises a manipulating portion to be manipulated with a finger, a pivot portion constituting the center of rotation, and a manipulating rod having an actuating portion at its distal end. In this case, the handle-engaging member is rotated by means of the actuating portion so as to be engaged with the mount base. The handle-engaging member comprises a pivot portion constituting the center of rotation, an actuating arm portion extending outwardly in the radial direction from the pivot portion, and a movable serration which is integrally formed at the distal end portion of the actuating arm portion and designed to be engaged with a stationary serration formed circularly on the mount base. The actuating arm portion of the handle-engaging member is provided with a curved recessed portion, the inner wall of which is adapted to be contacted by the actuation portion of the control lever, thus making it possible to rotate the handle-engaging member through the rotation of the control lever.

Further, the handling device according to the invention comprises an engaging member's rotation-regulating mechanism, which is designed to regulate the rotation of the handle-engaging member so as to maintain the engagement of the handle-engaging member with the mount base. This engaging member's rotation-regulating mechanism should preferably be constituted by a latch body secured to a main case, a latch shaft slidably inserted into the latch body and provided at one end thereof with an enlarged flange portion, a latch knob formed at the other end of the latch shaft, and a compression coil spring which is interposed between the latch body and the latch knob.

In this case, rotation of the handle-engaging member is prevented as the outer circumferential wall of the enlarged flange portion contacts the end face of the actuating arm portion of the handle-engaging member. On the other hand, when the outer circumferential wall of the enlarged flange portion is prevented from contacting the end face of the actuating arm portion by pushing the latch knob with a finger, the handle-engaging member is allowed to rotate.

When the handling device according to the invention constructed in this manner is in the condition where the control lever is enabled to rotate and where the movable serration of the handle-engaging member is engaged with the stationary serration of the mount base to lock the handling device (a rear handle portion) to the mount base, so as to make the rear handle portion impossible to rotate, the enlarged flange portion of the engaging member's rotation-regulating mechanism is positioned on the rotation-regulating side, and the outer circumferential wall of the enlarged flange portion is located to contact with the end face of the actuating arm portion of the handle-engaging member. As a result, the rotation in the engagement-releasing direction of the handle-engaging member is prevented by the enlarged flange portion, i.e. the movable serration is rendered impossible to disengage from the stationary serration, so that the rear handle portion is kept locked relative to the mount base.

When it is desired to rotate the rear handle portion so as to change its position relative to the mount base in conformity with the change in working posture of the operator, this can be accomplished by pushing the latch knob of the engaging member's rotation-regulating mechanism in the engagement-releasing direction with one's finger, so as to allow the handle-engaging member to move in the engagement-releasing direction. As a result, the engagement between the mount base and the rear handle portion is released and the movable serration is detached from the stationary serration. Accordingly, it is then possible to change the locking position of the rear handle portion relative to the mount base by rotating the rear handle portion.

Further, when the handle-engaging member is positioned on the engagement-releasing side, the enlarged flange portion of the latch shaft is prevented from moving toward the rotation-regulating side by the end face of the actuating arm portion of the handle-engaging member and is kept in that position.

When the movable serration of the handle-engaging member is desired to be engaged again with the stationary serration of the mount base, the control lever is rotated so as to force the actuation portion of the throttle lever to move along the inner wall of the curved recessed portion of the handle-engaging member, thereby rotating and pushing the handle-engaging member. As a result, the movable serration of the handle-engaging member is allowed to be engaged with the stationary serration of the mount base, and hence the rear handle portion is locked relative to the mount base.

When the handle-engaging member is rotated in this manner, the end face of the actuating arm portion of the handle-engaging member is also caused to move, so that the blocking of movement of the enlarged flange portion of the latch shaft of the engaging member's rotation-regulating mechanism is released. As a result, the enlarged flange portion is allowed to automatically return back to the rotation-regulating position due to the resilient force of the compressed coil spring. Hence, the rotation in the rotation-regulating direction of the handle-engaging member is again prevented.

The aforementioned sequence of movements is contemplated in view of ensuring the safety of working, so that the working portion is prevented from being inadvertently actuated at the moment of release of the engagement between the mount base and the rear handle portion.

Furthermore, since the handling device according to this embodiment is provided with the engaging member's rotation-regulating mechanism, the mount base and the rear handle portion can be automatically locked once they are engaged with each other, so that it is impossible to release their mutual engagement unless the latch knob of the engaging member's rotation-regulating mechanism is intentionally pushed. Thus, the handling device according to this embodiment is designed to ensure that engagement between the mount base and the rear handle portion will be maintained, as well as to ensure safety at the moment of release of the engagement therebetween.

There is also provided according to this invention another embodiment of the handling device, which is characterized in that the control lever is provided, on one end of the pivot portion thereof, with an engaging pawl extending toward the handle-engaging member, and in that the handle-engaging member is provided with an engaging portion on the upper surface of one side of an actuating arm portion. The engaging pawl and the engaging portion are adapted to come into contact with each other in a rotating manipulation of the control lever under a condition where the handle-engaging member is being rotated rearward, and are adapted to be prevented from coming into contact with each other in a rotating manipulation of the control lever under a condition where the handle-engaging member is being rotated forward and the movable serration is engaged with the stationary serration of the mount base.

The handling device according to the invention is provided with such engaging pawl and engaging portion so as to cope with a case in which the movable serration of the handle-engaging member and the stationary serration of the mount base are misaligned with each other. In such case, rotation of the throttle lever is restricted so as to prevent the upper portion of the curved recessed portion of the handle-engaging member from being forcibly pushed by the actuation portion of the throttle lever, thus preventing the actuating portion and the curved recessed portion from being distorted or fractured.

BRIEF DESCRIPTION OF THE SEVERAL VIEWS OF THE DRAWING

FIG. 8 (FIGS. 8A and 8B together) is a cross-sectional view taken along the line VIII—VIII of the engaging member's rotation-regulating mechanism of the handling device shown in FIG. 3, wherein

DETAILED DESCRIPTION OF THE PREFERRED EMBODIMENTS

One preferred embodiment of a handling device for a power working machine according to the present invention will be explained below with reference to the drawings.

Figure 1:
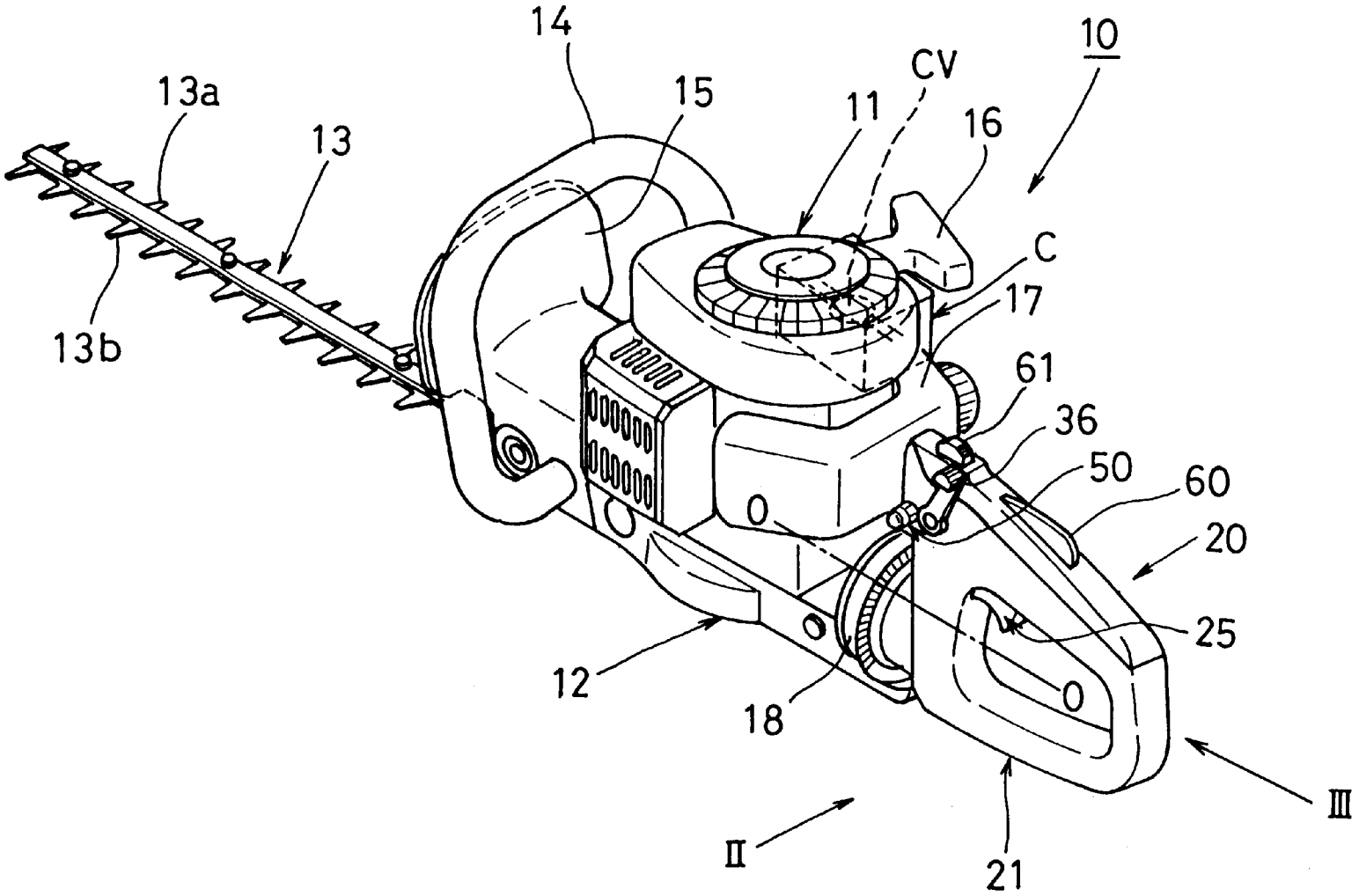
FIG. 1 is a general perspective view illustrating a hedge trimmer provided with a handling device according to one embodiment of the present invention.

FIG. 1 shows a perspective view illustrating one embodiment of a hedge trimmer 10 provided with a handling device, or rear handle portion 20, according to this embodiment. The hedge trimmer 10 comprises an air-cooled two-stroke gasoline internal combustion engine 11 as a prime mover, a mount base portion 12 enclosing a transmission case having a power transmission device, such as gears, to be actuated by the internal combustion engine 11, a working portion 13 composed of a pair of upper and lower clipper blades 13*a* and 13*b* which are to be actuated via the aforementioned power transmission device by the internal combustion engine 11, a loop-shaped front handle portion 14 mounted on a forward portion of the mount base 12, a hand protector 15 attached to the vicinity of the front handle portion 14, and the rear handle portion 20 mounted on a rearward portion of the mount base 12.

A recoil starter 16 and a fuel tank 17 are attached to the internal combustion engine 11, in which conventional control members such as a carburetor C having a throttle valve CV and an ignition plug (not shown) are installed. The pair of upper and lower clipper blades 13*a* and 13*b* constituting the working portion 13 are designed to be reciprocatingly driven relative to each other in a conventional manner by means of the internal combustion engine 11 via the power transmission device. The rear handle portion 20 is mounted on the mount base 12 in such a manner that it is pivotally rotatable about an axial line O—O which is parallel with the longitudinal axial line of the clipper blades 13*a* and 13*b*, and such that it can be locked at any rotational position. A throttle lever 25 and a sub-throttle lever 36, both functioning as a control lever for controlling the opening degree of the throttle valve CV, are attached to the rear handle portion 20.

Figure 2:
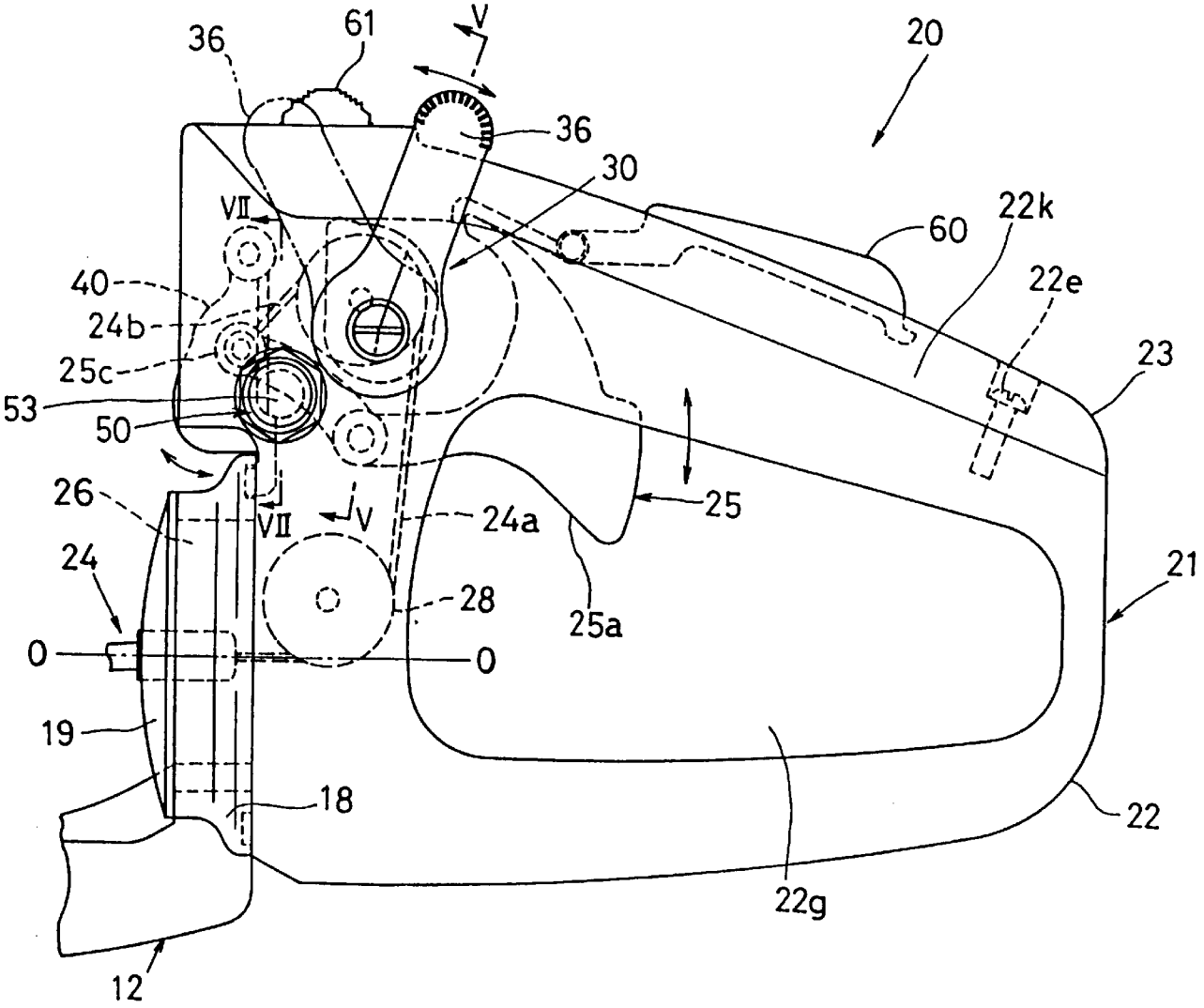
FIG. 2 is a left side view, as viewed in the direction of arrow II, of the handling device shown in FIG. 1.
Figure 4:
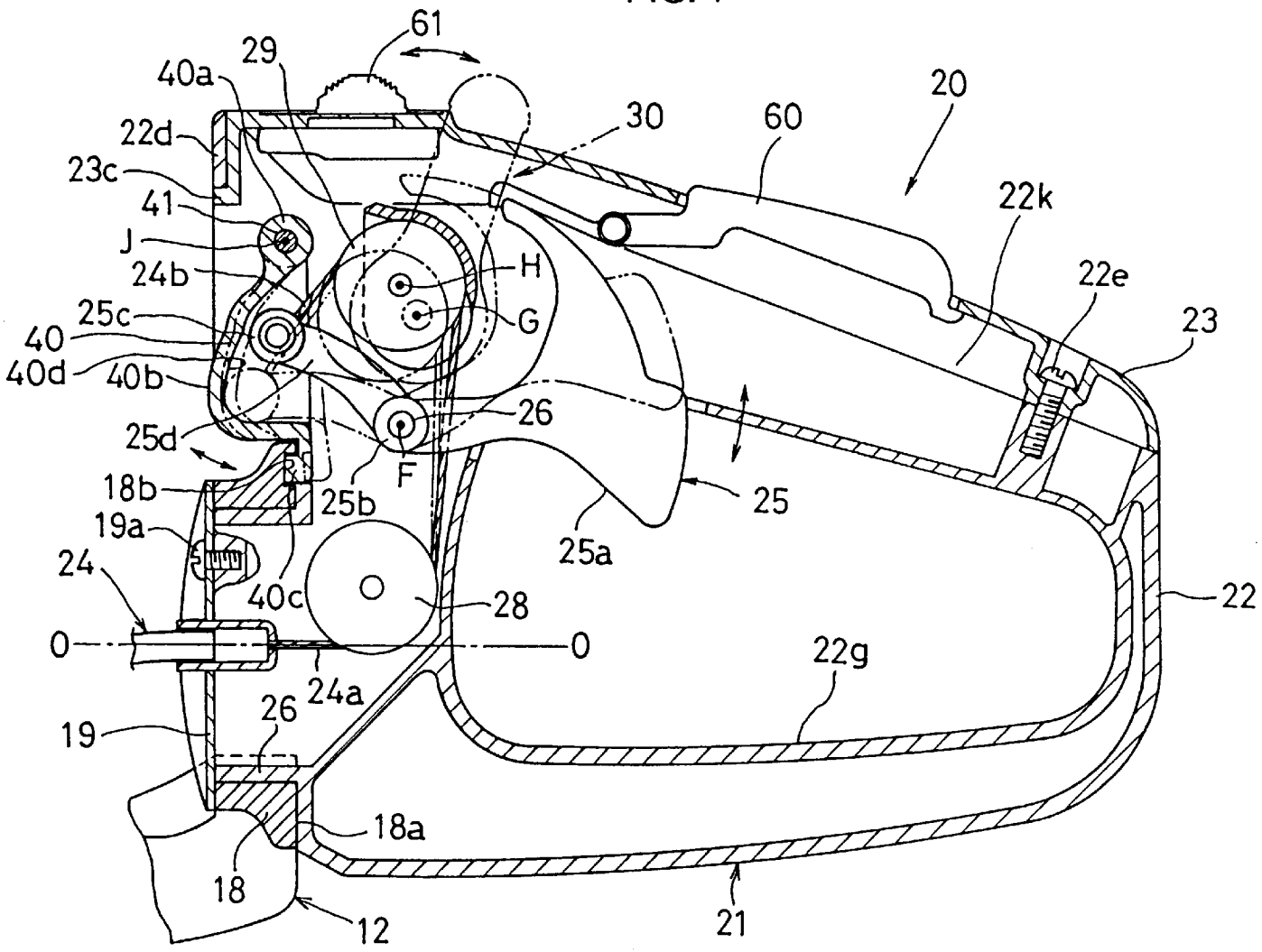
FIG. 4 is a longitudinal sectional view taken along the line IV—IV of the handling device shown in FIG. 3.

As clear from FIG. 2 showing the external appearance and FIG. 4 showing the cross-sectional view, the rear handle portion 20 is provided with a hollow loop-shaped case member 21, which is rotatably mounted on the rear end portion of the mount base 12 and is designed to be locked at any rotational position. Specifically, the mount base 12 is integrally provided at its rear end with a cylindrical receiver 18, while the case member 21 of the rear handle portion 20 is provided at its front portion with a cylindrical supporting body 26. This cylindrical supporting body 26 is inserted into the cylindrical receiver 18, and a disk-like fixing plate 19 is contacted with the foreside (facing forward) of the cylindrical receiver 18, whereby the rear handle portion 20 is attached to the mount base 12. In this case, the disk-like fixing plate 19 is fastened to the cylindrical supporting body 26 by means of small screws 19*a* in such a manner that there is a minimal clearance between the cylindrical receiver 18, on the one hand, and the disk-like fixing plate 19 and the cylindrical supporting body 26, on the other hand, thereby allowing the rear handle portion 20 to be rotated about the axial line O—O relative to the mount base 12.

As seen from FIG. 4, the case member 21 is constituted by a binary structure comprising a main case 22 made of plastic and a closure case 23 removably engaged with an upper opening of the main case 22. The engagement between the main case 22 and the closure case 23 is effected by inserting a projected portion 23*c* formed at the front edge portion of the closure case 23 into an open front portion of the main case 22 so as to hook it to a locking portion 22*d* of the main case 22, after which the rear end portion of the closure case 23 is fastened to the upper surface portion of the main case 22 by means of a small screw 22*e*.

A throttle cable 24*a* inserted in a Bowden cable 24 and connected with the throttle valve CV of the internal combustion engine 11 is guided, along the axial line O—O, into the rear handle portion 20. A throttle lever 25, which is adapted to pull the throttle cable 24*a*, is secured in the case member 21 of the rear handle portion 20 in such a manner that it is pivotable about an axial line F—F orthogonally intersecting with the aforementioned axial line O—O.

The main case 22 is shaped to form an open space 22*g* which enables the operator's hand to be inserted therein, and a grip portion 22*k* constituted by an upper portion of the main case 22 and the closure case 23 is also formed for the convenience of carrying the hedge trimmer 10 by hand.

Figure 5:
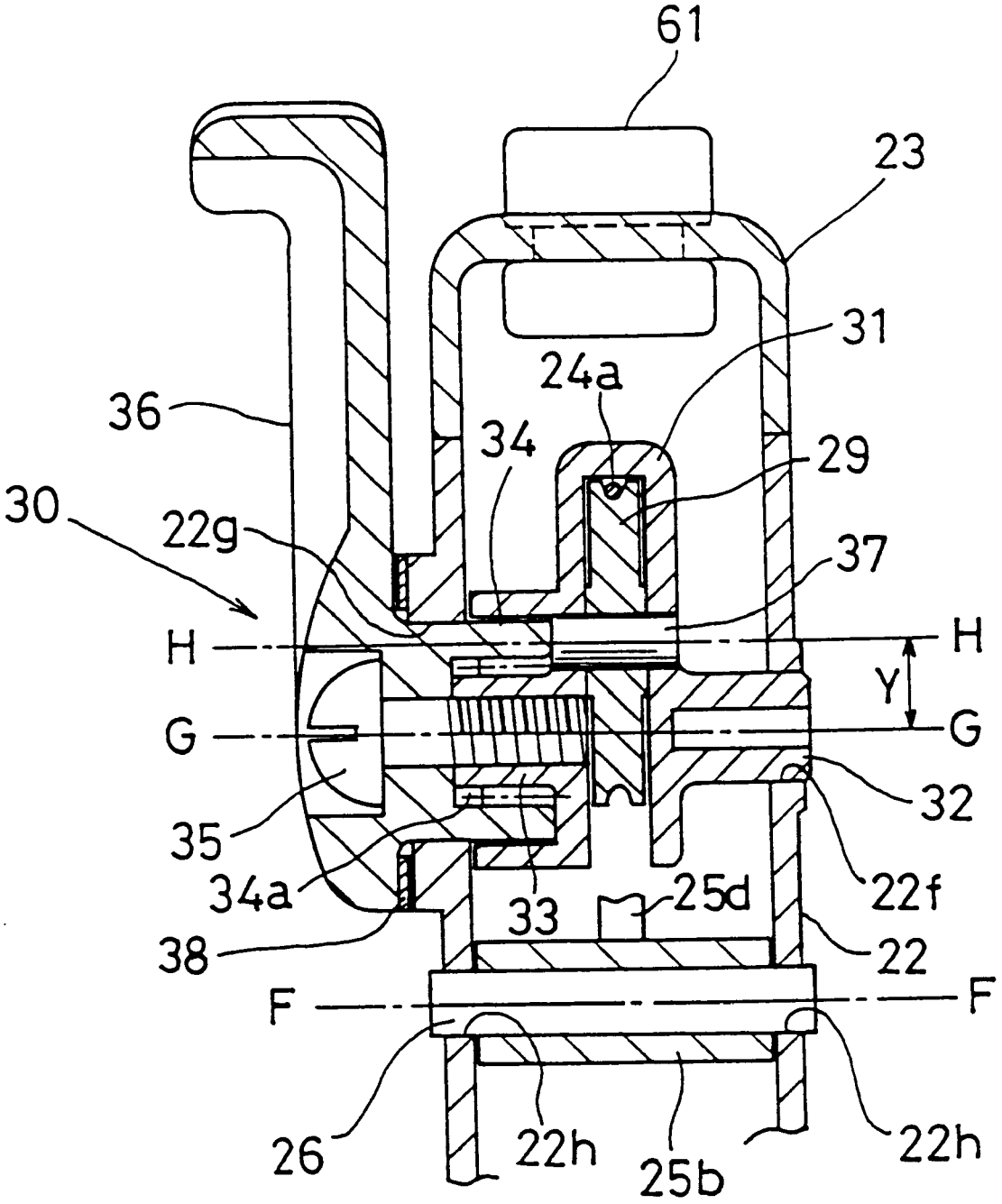
FIG. 5 is an enlarged cross-sectional view taken along the line V—V of the handling device shown in FIG. 2.
Figure 6:
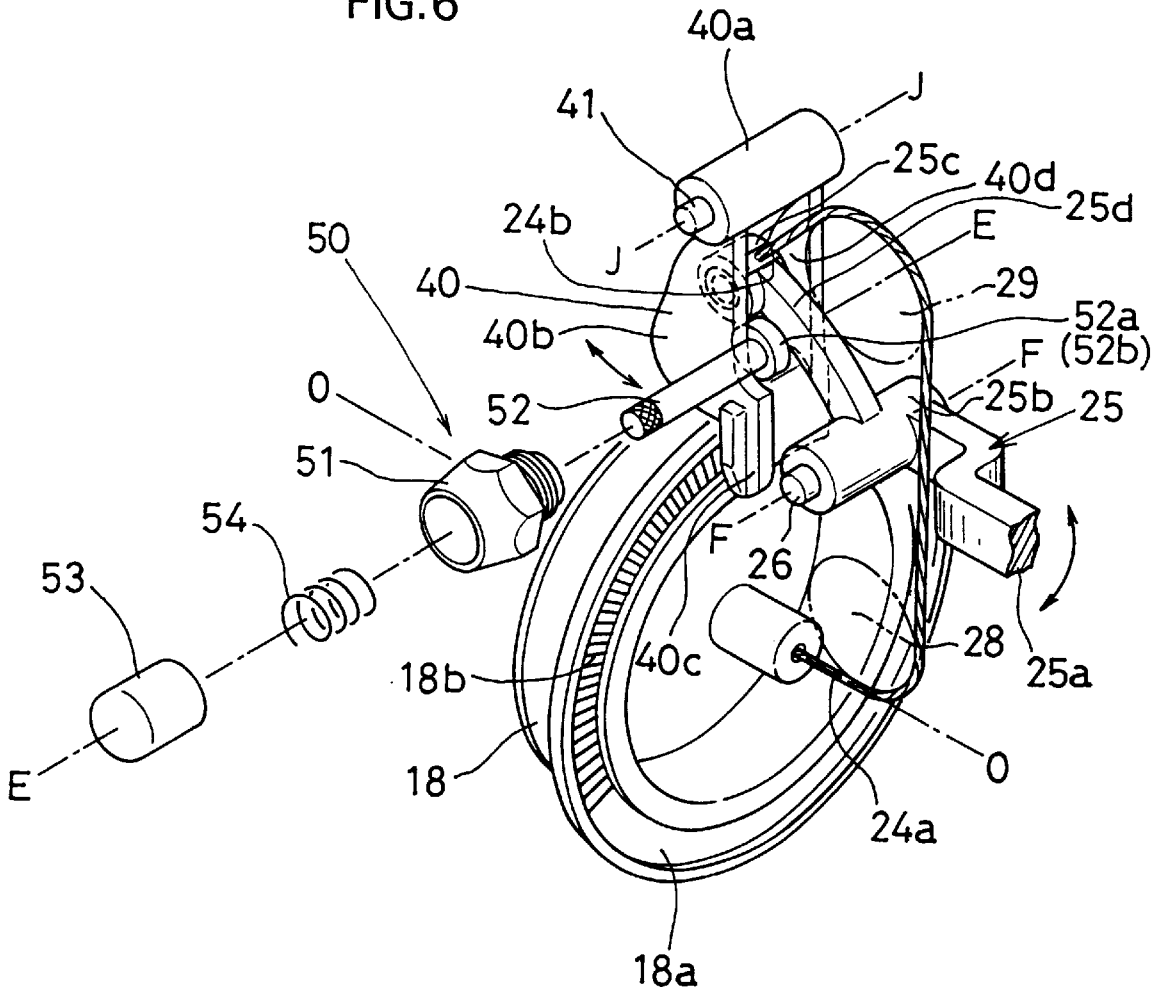
FIG. 6 is a perspective view of a main portion of the handling device shown in FIG. 4.

The throttle lever 25, pivotally secured to the main case 22, protrudes from the lower portion of the grip portion 22*k* into the hollow space in the main case 22. This throttle lever 25 is integrally constituted by a manipulating portion 25*a* to be actuated with a finger, a cylindrical portion 25*b* constituting the pivot for the throttle lever 25 and externally loosely fitted around a lever-supporting pin 26 which is in turn secured along the axis F—F to the main case 22, and an actuating rod 25*d* which is housed within the main case 22 and extends from the cylindrical portion 25*b* in a direction opposite to the manipulating portion 25*a* and has at its distal end a roll-shaped actuating portion 25*c*. As shown in FIG. 5, both ends of the lever-supporting pin 26 are forcibly inserted into holes 22*h* formed in the main case 22. The distal end 24*b* of the throttle cable 24*a* is connected to the actuating portion 25*c*.

The closure case 23 is provided on its upper surface with a conventional safety lever 60, which is designed to prevent the throttle lever 25 from being rotated upward if the rear handle portion 20 is not properly grasped by the operator's hand, thereby insuring that the throttle lever 25 is not inadvertently rotated in the direction to open the throttle valve CV. The closure case 23 is also provided on its upper surface with a sliding type engine shut-off switch 61, which is designed to break an electric circuit for the ignition plug of the internal combustion engine 11, thereby stopping the operation of the engine 11.

According to this embodiment, a pair of pulleys, i.e., a standing pulley 28 and a movable pulley 29, are disposed in the main case 22. The throttle cable 24*a* extending from the throttle valve CV passes around the standing pulley 28, i.e. entering thereon from the lower side thereof and then extending therefrom upward, then the throttle cable 24*a* passes around the movable pulley 29, i.e. entering thereon from the upper side thereof and then extending therefrom forward and downward, with the distal end 24*b* of the throttle cable 24*a* being connected to the actuating portion 25*c*.

The main case 22 is provided with a position control mechanism 30 which is designed to move the movable pulley 29 upward and downward. This position control mechanism 30 is designed to adjust the level of the movable pulley 29, thus positioning it at a desired location, and, at the same time, to keep the throttle cable 24*a* in a desired pulling position. As shown in FIG. 5, the position control mechanism 30 includes a rotatable axle 32 provided thereon with a housing 31 carrying the movable pulley 29, an outer circumferentially serrated axle 33 disposed on the left side of the housing 31, and an inner circumferentially serrated hub 34 provided with an inner circumferential serration 34*a* which engages the outer circumferential serration on the axle 33. A sub-throttle lever 36 is integrally attached to the outer end portion of the hub 34, and the two are secured to the axle 33 by a fastening screw 35.

The right end portion of the rotatable axle 32 is axially supported by a bearing 22*f* in the right side of the main case 22, while the inner circumferentially serrated hub 34 is axially supported by a bearing 22*g* in the left side of the main case 22. A corrugated spring washer 38 is interposed, in coaxial relation to the hub 34, between the main case 22 and the sub-throttle lever 36 so as to hold, by the effect of frictional force thereof, the sub-throttle lever 36 kept in place with respect to the main case 22.

The movable pulley 29 housed in the housing 31 of the rotatable axle 32 is pivotally mounted on a supporting pin 37. In this case, the axial line H—H of the supporting pin 37 is offset from the rotating axis G—G (the axial line of the rotatable axle 32) of the sub-throttle lever 36 by a distance of Y. Therefore, when the sub-throttle lever 36 is rotated rearward as shown by phantom lines in FIG. 4, the movable pulley 29 is forced to be lifted upward, thereby causing the throttle cable 24*a* to be moved in a direction of opening the throttle valve CV in resistance to its spring action, which conventionally is normally biased in the direction to close the throttle valve CV.

Figure 3:
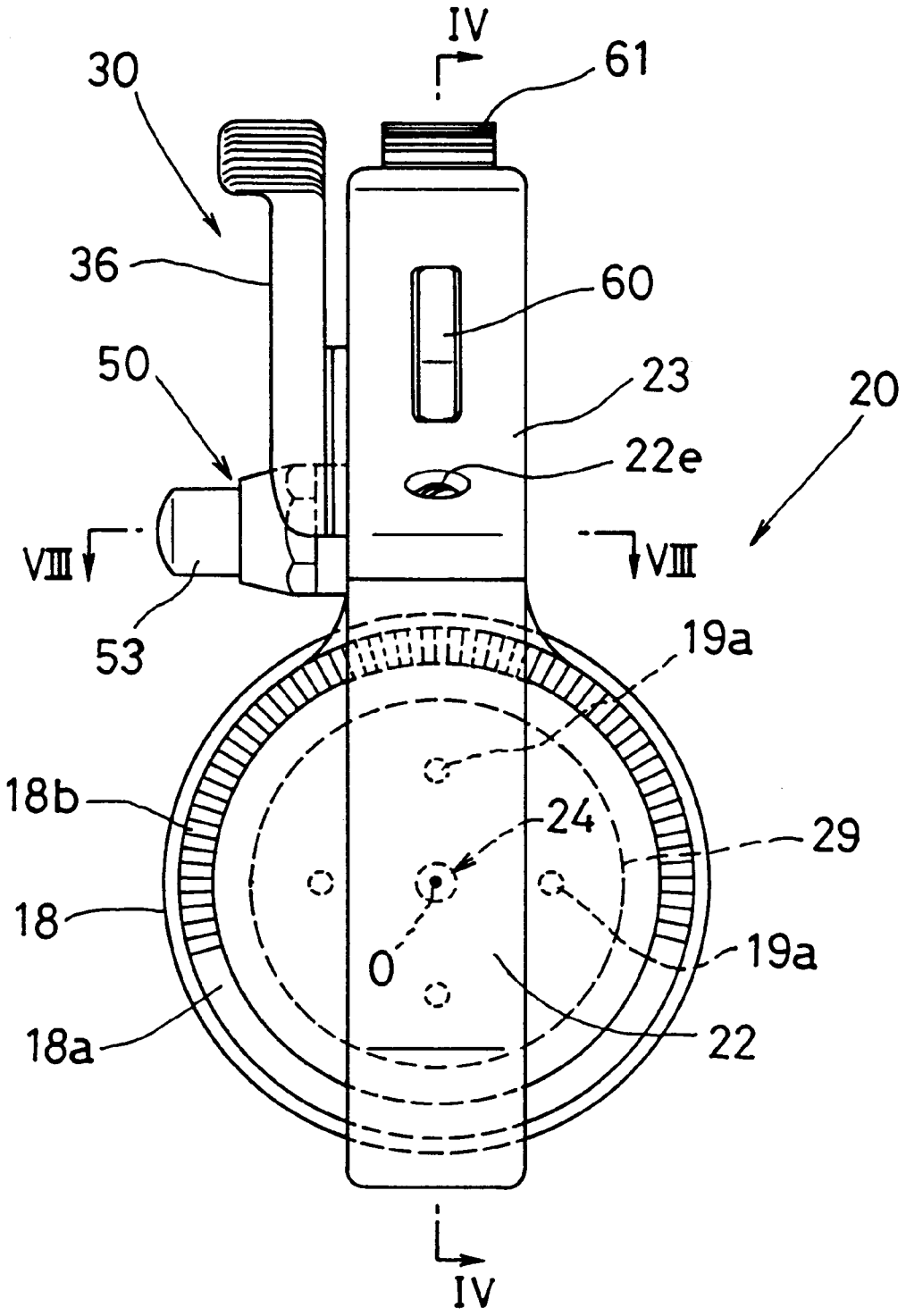
FIG. 3 is a back side view, as viewed in the direction of arrow III, of the handling device shown in FIG. 1.

As shown in FIGS. 3 and 4, a stationary serration 18*b* is formed on a ring-like rear side 18*a* of the cylindrical receiver 18 of the mount base 12 such that the serrated portion extends circularly about the longitudinal axial line O—O over almost the upper semicircular range portion of the ring-like rear side 18*a*. Further, as shown in FIG. 4, at the upper front portion within main case 22, a handle-engaging member 40 is pivotally mounted on a supporting pin 41 having an axial line J—J which is parallel with the lateral axial line F—F.

Figure 7:
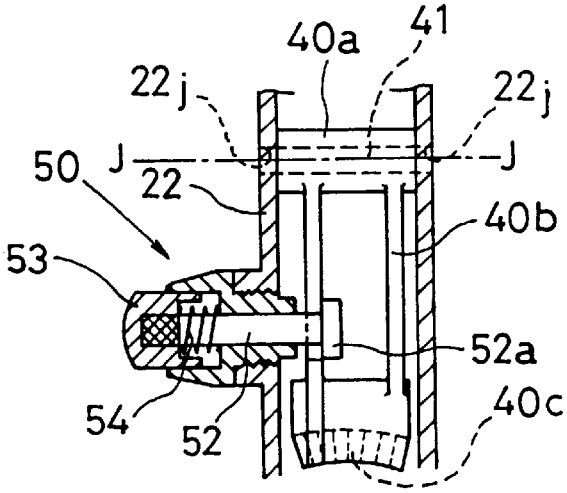
FIG. 7 is a cross-sectional view taken along the line VII—VII of the handling device shown in FIG. 2.

The handle-engaging member 40 comprises, as shown in FIG. 7, a cylindrical portion 40*a* functioning as a pivot portion and loosely fitted over the axial line J—J of the supporting pin 41, an actuating arm portion 40*b* radially and downwardly extending from the cylindrical portion 40*a*, and a movable serration 40*c* formed at the lower end of the actuating arm portion 40*b*. As shown in FIG. 7, both ends of the supporting pin 41 are forcibly inserted into holes 22*j* formed in the main case 22.

As shown in FIG. 4, the actuating arm portion 40*b* is provided with a curved recessed portion 40*d*, the inner wall of which is adapted to be contacted by the actuation portion 25*c* of the throttle lever 25. Namely, when the throttle lever 25 is rotated, the actuation portion 25*c* is caused to move up and down while contacting the inner wall of the curved recessed portion 40*d*, thus causing the lower portion of the handle-engaging member 40 to swing in the longitudinal direction.

The radius of curvature of the curved recessed portion 40*d*, having its center at the supporting pin 26, is dimensioned as shown in FIG. 4 such that the radius of curvature of the upper half portion is made slightly larger than the lower half portion so as to inhibit the handle-engaging member 40 from pivotally moving at the initial stage of pulling the throttle lever 25, thus improving the manipulability of the rear handle portion. The movable serration 40*c* is formed by cutting the plane of the lower end of the actuating arm portion 40*b* which faces the stationary serration 18*b* of the cylindrical receiver 18 into a serrated configuration, and is adapted to be engaged with or disengaged from the stationary serration 18*b* of the cylindrical receiver 18 as the handle-engaging member 40 is pivotally moved forward or rearward in the longitudinal direction. However, the movable serration 40*c* is usually biased by a suitable biasing means, e.g. a spring, (not shown) such that the movable serration 40*c* is rearwardly detached as shown by the phantom lines in FIG. 4. When the handle-engaging member 40 is pushed forward in resistance to the biasing force of the biasing means, the stationary serration 18*b* is brought into engagement with the movable serration 40*c*, whereby the rear handle portion 20 is locked to the mount base 12. When the aforementioned pushing force is released to disengage the movable serration 40*c* from the stationary serration 18*b*, the rear handle portion 20 is free to rotate relative to the mount base 12.

Figure 8A:
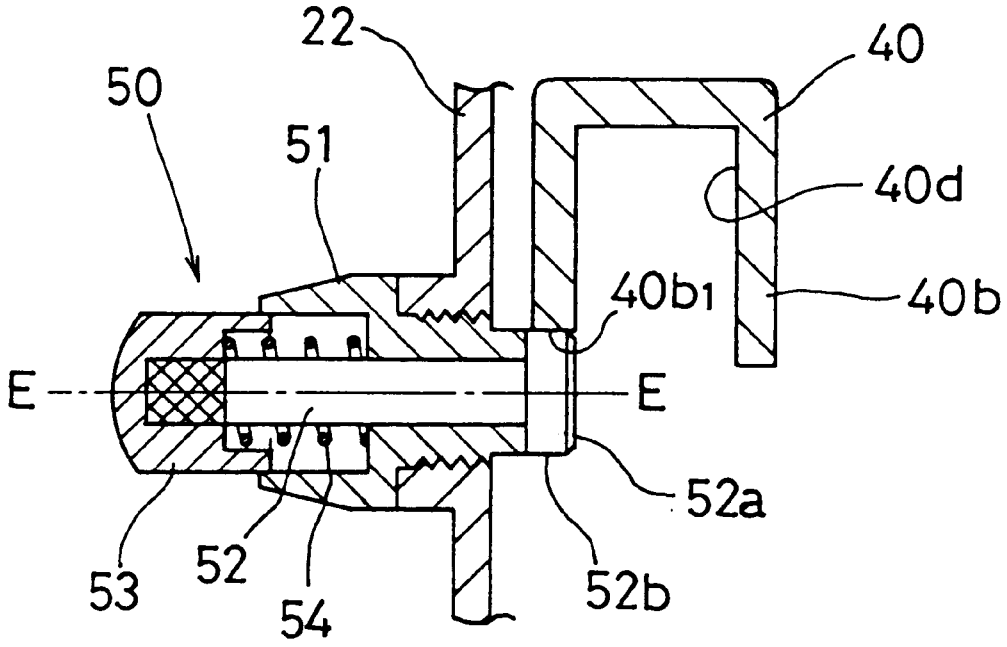
FIG. 8(A) illustrates a state wherein the movement of handle-engaging member is regulated.
Figure 8B:
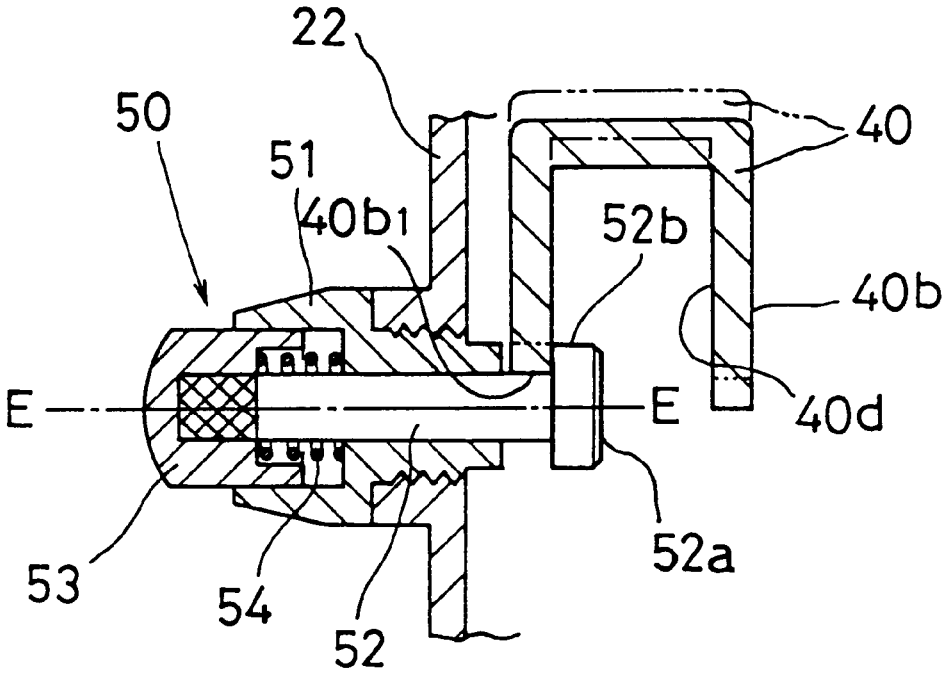
FIG. 8(B) illustrates a state wherein the handle-engaging member is allowed to move.

As shown in FIGS. 8A and 8B, an engaging member's rotation-regulating mechanism 50 is disposed in the vicinity of the handle-engaging member 40. The mechanism 50 comprises a latch body 51 threaded into the main case 22, a latch shaft 52 slidably inserted into the latch body 51 and provided at the inner end thereof with an enlarged flange portion 52*a* which is positioned in the main case 22, a latch knob 53 press-fitted on the outer end of the latch shaft 52, and a coil spring 54 which is loosely fitted around the latch shaft 52 and interposed between the latch body 51 and the latch knob 53.

Both the latch shaft 52 and the latch knob 53 are slidably disposed as an integral piece in the latch body 51, while allowing the enlarged flange portion 52*a* to be positioned in the interior of the main case 22, and are usually biased to the left side of the main case 22 by the resilient action of the compression coil spring 54.

FIG. 8A shows a state in which the latch shaft 52 is positioned at the left outermost side of the main case 22. Under this condition, the outer circumferential wall 52*b* of the enlarged flange portion 52*a* of latch shaft 52 is located opposite the end face 40*b*1 of the actuating arm portion 40*b* of the handle-engaging member 40. In this case, the rotation in the rearward direction of the handle-engaging member 40 is prevented by the enlarged flange portion 52*a*, i.e. the movable serration 40*c* of the handle-engaging member 40 is engaged with the stationary serration 18*b* of the mount base 12, so that the rear handle portion 20 is rotationally locked in relation to the mount base 12.

FIG. 8B shows a state in which the latch knob 53 is depressed in resistance to the resilient force of the compression coil spring 54, so that the enlarged flange portion 52*a* of latch shaft 52 is entirely located within the curved recessed portion 40*d* of the actuating arm portion 40*b* of handle-engaging member 40. In this case, the handle-engaging member 40 is biased rearward to a sufficient degree to allow the movable serration 40*c* of the handle-engaging member 40 to be disengaged from the stationary serration 18*b* of the mount base 12, as that the rear handle portion 20 is free to rotate relative to the mount base 12.

Next, the operation of the aforementioned handling device (rear handle portion) 20 according to the foregoing embodiment will be explained.

According to the rear handle portion 20 of this embodiment, the internal combustion engine 11 is started by manipulating the recoil starter 16 under the conditions where the rear handle portion 20 is locked in a selected place to the mount base 12 (a state indicated by solid lines in FIG. 2), the throttle lever 25 is positioned in the non-operation state (a state shown in FIG. 2), and the sub-throttle lever 36 is rotated forward (in the direction of working portion 13) (a state indicated by phantom lines in FIG. 2). However, since the internal combustion engine 11 is in a state of idling and low in engine speed under these conditions, the centrifugal clutch (not shown) which is interposed between the engine 11 and the power transmission device cannot be actuated, so that the clipper blades 13*a* and 13*b* of the working portion 13 are still prevented from reciprocally moving.

Under these conditions, the safety lever 60 is pushed downward with the palm of the hand properly grasping the handle portion 20 so as to release the lock of the throttle lever 25, after which the manipulating portion 25*a* of the throttle lever 25 is rotated upward by finger to the uppermost position, thereby causing the actuating portion 25*c* of the throttle lever 25 to move downward and pull the throttle cable 24*a* for a predetermined distance via the standing pulley 28 and the movable pulley 29. As a result, the throttle cable 24*a* is tensioned without play.

At this state, the pulling distance (magnitude of displacement) of the throttle cable 24*a* by the throttle lever 25 is the same as the magnitude of movement of the actuating portion 25*c*.

Then, while keeping the throttle lever 25 rotated at the uppermost position, the sub-throttle lever 36 is rotated rearward to a desired position in resistance to the resilient force of the corrugated spring washer 38, the movable pulley 29 is shifted upward, thereby pulling the throttle cable 24*a* upward. Since the end portion 24*b* of the throttle cable 24*a* is connected to the actuating portion 25*c* and prevented from moving, the throttle cable 24*a* is pulled in the direction to open the throttle valve CV, and hence the throttle valve CV is moved from the minimum open position (idling opening) up to the fully open position, thereby making it possible to adjust the opening degree of the throttle valve CV.

In this case, since the throttle cable 24*a* is pulled through the movable pulley 29 while the throttle cable 24*a* is wound around the movable pulley 29, the throttle cable 24*a* is pulled for a distance which is almost twice as large as the shifted distance of the movable pulley 29. Therefore, the magnitude of manipulation of the sub-throttle lever 36, i.e. the magnitude of shifting the movable pulley 29, which is required for adjusting the opening degree of the throttle valve CV, can be minimized, thus making it possible to miniaturizing the apparatus in this respect.

If the rotating operation of the sub-throttle lever 36 is terminated at a predetermined position by removing the operator's finger from the sub-throttle lever 36, the sub-throttle lever 36 is kept in an immobilized state at the manipulated position by the effect of the resilience force of the corrugated spring washer 38, and hence the throttle valve CV is kept at this opening degree (a predetermined opening degree). As a result, the load on the operator's hand can be alleviated.

If the revolving speed of the internal combustion engine 11 is desired to be greatly reduced, e.g., due to an unexpected accident, under the condition where the opening degree of the throttle valve CV is being suitably controlled as mentioned above, the throttle lever 25 is released by the operator. As a result, since the throttle cable 24*a* is biased in the direction to close the throttle valve CV, the throttle lever 25 is forcibly pulled back to the original position, thus allowing the throttle cable 24*a* to return to the non-manipulation state, causing the throttle valve CV to take the previous idling opening degree and returning the internal combustion engine 11 to take an idling state.

In the case of the hedge trimmer 10 which is designed to transmit the rotational driving force of the internal combustion engine 11 to the working portion 13 constituted by the clippers 13*a* and 13*b* via a centrifugal clutch (not shown), when the revolution speed of the engine 11 is reduced, the centrifugal clutch returns or assumes a cutoff state, thus resulting in the cutoff of power transmission to the working portion 13 and in the immediate stoppage of the movement of working portion 13, i.e. the clippers 13*a* and 13*b*.

When the throttle lever 25 is again manipulated by finger to rotate up to the predetermined uppermost position after the throttle lever 25 is once released as mentioned above, the play of the throttle cable 24*a* is eliminated and the throttle valve CV is returned to the previous opening degree that had been set prior to the throttle lever 25 having been released, since the sub-throttle lever 36 is kept in the previous manipulation position. As a result, readjustment of the sub-throttle lever 36 is not required.

As mentioned above, in the conditions where the throttle lever 25 is enabled to rotate and where the movable serration 40*c* of the handle-engaging member 40 is engaged with the stationary serration 18*b* of the mount base 12 to lock the rear handle portion 20 to the mount base 12 so as to lock the rear handle portion 20 against rotation, the handle-engaging member 40 and the engaging member's rotation-regulating mechanism 50 are interrelated in position as shown in FIG. 8A (the handle-engaging member 40 is indicated by a solid line). Namely, the enlarged flange portion 52*a* of the engaging member's rotation-regulating mechanism 50 is positioned at the leftmost side, and the outer circumferential wall 52*b* of the enlarged flange portion 52*a* is located to contact the end face 40*b*1 of the actuating arm portion 40*b* of the handle-engaging member 40. As a result, rotation in the rearward direction of the handle-engaging member 40 is prevented by the enlarged flange portion 52*a*. Consequently, the movable serration 40*c* is prevented from disengaging from the stationary serration 18*b* and, therefore, the rear handle portion 20 is kept locked relative to the mount base 12.

When it is desired to rotate the rear handle portion 20 of the hedge trimmer 10 about the longitudinal axial line O—O so as to change the locking position thereof relative to the mount base 12 in conformity with the change in working posture of the operator, this can be done by pushing rightward (to the right in FIG. 8B) the latch knob 53 of the engaging member's rotation-regulating mechanism 50 with one's finger, thus obtaining the state as shown in FIG. 8B.

In this state, the handle-engaging member 40 is capable of moving rearward (to the right in FIG. 4), i.e., moving to a position indicated in phantom lines in FIG. 4. If the handle-engaging member 40 is biased by a biasing means such as a spring (not shown) in the rearward direction in this case, the handle-engaging member 40 can be automatically returned to the state indicated by phantom lines in FIG. 4, thus providing a state where the engagement of the rear handle portion 20 is disengaged from the mount base 12, and the movable serration 40*c* is detached from the stationary serration 18*b*. Accordingly, it is now possible to change the rotational locking position of the rear handle portion 20 relative to the mount base 12 by rotating the rear handle portion 20. Further, since the handle-engaging member 40 is rotated rearward, the enlarged flange portion 52*a* is prevented from moving leftward by the end face 40*b*1 of the actuating arm portion 40*b* of the handle-engaging member 40 and is held in a position as indicated by solid lines in FIG. 8B, where the coil spring 54 is compressed.

When the movable serration 40*c* of the handle-engaging member 40 is desired to again be engaged with the stationary serration 18*b* of the cylindrical receiver 18, the throttle lever 25 is caused to move upward by properly grasping the rear handle portion 20. With this upward movement of the throttle lever 25, the actuating portion 25*c* of the throttle lever 25 is forced to move downward along the inner wall of the curved recessed portion 40*d* of handle-engaging member 40 (the position indicated by phantom lines in FIG. 4) so as to cause the handle-engaging member 40 to rotate forward (the position indicated by solid lines in FIG. 4). As a result, the movable serration 40*c* of the handle-engaging member 40 again engages the stationary serration 18*b* of the cylindrical receiver 18, and hence the rear handle portion 20 is again locked relative to the mount base 12.

When the handle-engaging member 40 is rotated forward, the end face 40*b*1 of the actuating arm portion 40*b* of the handle-engaging member 40 is also caused to move forward, so that the blocking of leftward (as seen in FIG. 8A) movement of the enlarged flange portion 52*a* of the engaging member's rotation-regulating mechanism 50 is released, thereby allowing the enlarged flange portion 52*a* to return back to the position indicated in FIG. 8A by the resilient force of the compressed coil spring 54. Hence, the rearward rotation of the handle-engaging member 40 is again prevented.

A sequence of movements occurs when the handle-engaging member 40 is rotated forward by the upward rotation of the throttle lever 25 such that the movable serration 40*c* of the handle-engaging member 40 engages with the stationary serration 18*b* of the cylindrical receiver 18 and thereby locks the rear handle portion 20 relative to the mount base 12. In other words, whenever the clipper blades 13*a* and 13*b* are rendered capable of actuation by the internal combustion engine 11 by rotatably moving the throttle lever 25 upward, so as to open the throttle valve CV, the rear handle portion 20 is always rotationally locked to the cylindrical receiver 18. Conversely, unless the rear handle portion 20 is locked to the cylindrical receiver 18, it is impossible to actuate the clipper blades 13*a* and 13*b* by increasing the output of the internal combustion engine 11 through the manipulation of the throttle lever 25 and the sub-throttle lever 36.

The aforementioned sequence of movements is contemplated in view of ensuring the safety of working, so that the clipper blades 13*a* and 13*b* are prevented from being inadvertently actuated at the moment of releasing the engagement between the mount base 12 and the rear handle portion 20.

Furthermore, since the handling device according to this embodiment is provided with the engaging member's rotation-regulating mechanism 50, the mount base 12 and the rear handle portion 20 are automatically locked once they are engaged with each other, so that it is impossible to release the engagement therebetween unless the latch knob 53 of the engaging member's rotation-regulating mechanism 50 is intentionally pushed. Namely, the handling device according to this embodiment is designed to ensure the maintenance of engagement between the mount base 12 and the rear handle portion 20, as well as to ensure safety at the moment of the release of the engagement therebetween.

Additionally, it is possible according to the handling device of this embodiment to adjust the opening degree of the throttle valve CV (a member to be actuated) via the cable 24*a* and, at the same time, to easily keep a desired opening degree and immediately return to the minimum opening degree (opening for idling). Therefore, a highly safe operation can be assured and, at the same time, fatigue of the operator's finger can be avoided. When it is desired to reset the throttle valve CV to an opening degree which has been set before the throttle valve CV is returned to idling position, this can be realized automatically without requiring re-adjustment of the handling device. Moreover, it is possible according to the handling device of this embodiment to miniaturize and lighten the apparatus as a whole, and to improve the workability and operability of the apparatus.

In the foregoing explanation, the present invention has been explained with reference to one embodiment. However, the present invention should not be construed to be limited by this embodiment, but may be variously modified within the spirit and scope of the invention as defined in the claims.

For example, if it is desired to change the rotational engaging position of the rear handle portion 20 relative to the mount base 12 of the hedge trimmer 10 in conformity with the change in working posture of the operator, the rear handle portion 20 is rotated about the longitudinal axial line O—O and the movable serration 40*c* of the handle-engaging member 40 is then engaged with the stationary serration 18*b* of the mount base 12, so that the rear handle portion 20 is locked relative to the cylindrical receiver 18. On the other hand, rotation of the handle-engaging member 40 in the engaging direction is effected in this embodiment by a process wherein the throttle lever 25 is caused to move upward so as to move the actuating portion 25*c* of the throttle lever 25 downward along the inner wall of the curved recessed portion 40*d* of the handle-engaging member 40, thereby causing the handle-engaging member 40 to move forward and hence bring the movable serration 40*c* of the handle-engaging member 40 into engagement with the stationary serration 18*b* of the cylindrical receiver 18.

However, there is a possibility on the occasion of rotating the throttle lever 25 upward that the stationary serration 18*b* and the movable serration 40*c* may be misaligned with each other, i.e. the ridge of one serration contacts the ridge of the other. If this happens, the engagement between the stationary serration 18*b* and the movable serration 40*c* cannot work satisfactory even if the throttle lever 25 is rotated. As the upper portion of the curved recessed portion 40*d* of handle-engaging member 40 is strongly pushed by the actuating portion 25*c*, both the actuating portion 25*c* and curved recessed portion 40*d* may sometimes be distorted or fractured.

The handling device 20 according to a second embodiment of this invention shown in FIGS. 9 to 12 is constructed to cope with this problem as explained below.

Figure 9:
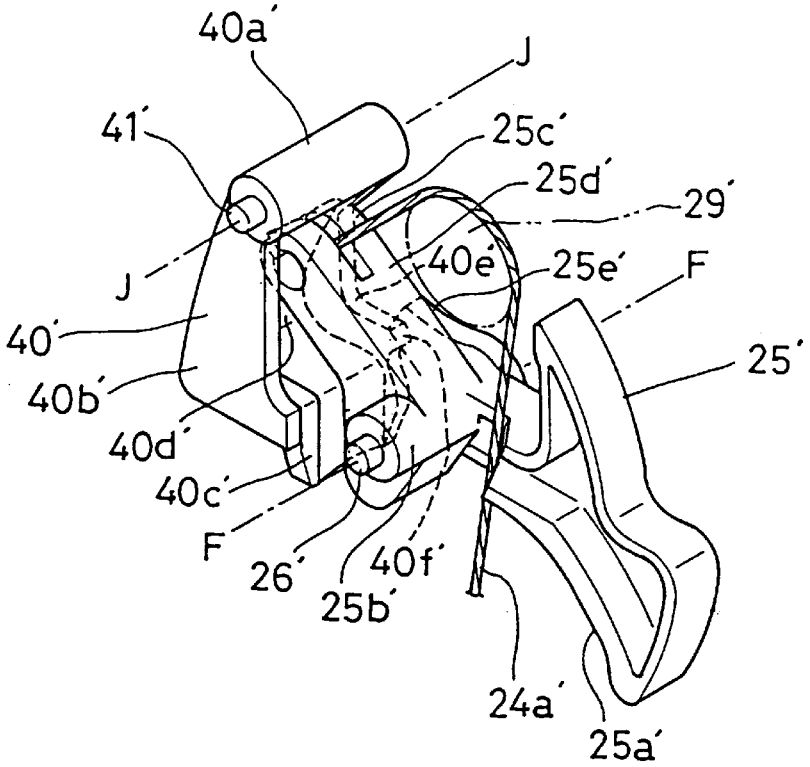
FIG. 9 is a partially broken perspective view of a main portion of the handling device according to a second embodiment of the invention.

FIG. 9 is a partially broken perspective view illustrating only a throttle lever 25' of the rear handle portion 20 and a handle-engaging member 40'. The other constituent members are the same as those illustrated in the aforementioned first embodiment and, hence, are omitted for ease of illustration. Like parts are identified by the same reference numbers as before but supplemented with a prime (') mark.

The throttle lever 25' is integrally constituted by a manipulating portion 25*a*' to be actuated by a finger, a cylindrical portion 25*b*' constituting the pivot for the throttle lever 25' and externally loosely fitted around a lever-supporting pin 26' which is in turn secured along the axis F—F to the main case 22, and an actuating member 25*d*' housed within the main case 22 and extending from the cylindrical portion 25*b*' in a direction opposite to the manipulating portion 25*a*' and having at its distal end a roll-shaped actuating portion 25*c*'.

The throttle lever 25' is provided on the right side (as seen in FIG. 9) of the cylindrical portion 25*b*' with an engaging pawl 25*e*' extending toward the handle-engaging member 40'.

The handle-engaging member 40' comprises, as shown in FIG. 9, a cylindrical portion 40*a*' functioning as a pivot portion and loosely fitted over the supporting pin 41', an actuating arm portion 40*b*' radially and downwardly extending from the cylindrical portion 40*a*', and a movable serration 40*c*' formed at the lower end of the actuating arm portion 40*b*'.

Figure 10:
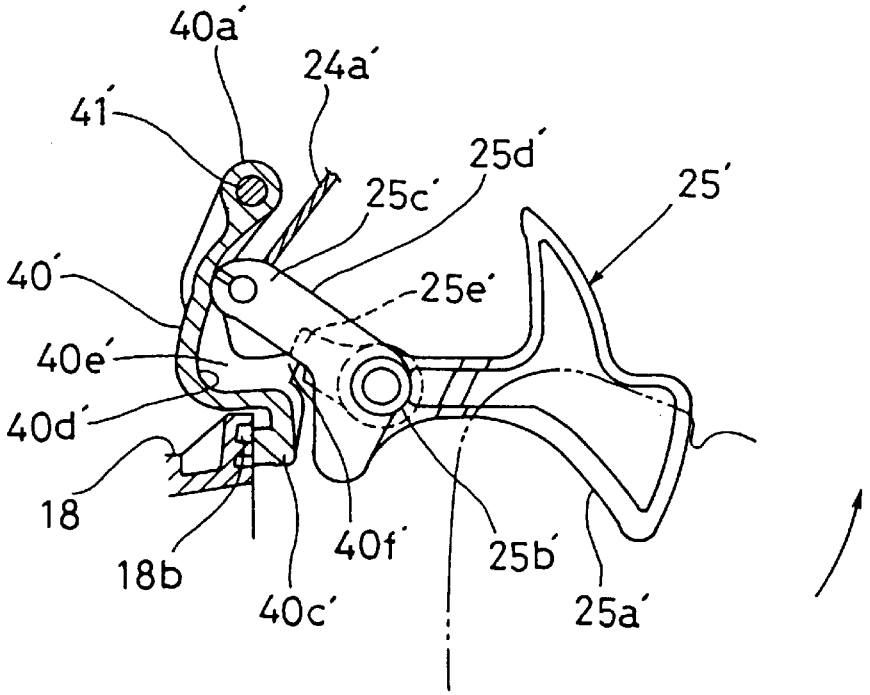
FIG. 10 is a partially sectioned side view illustrating an operational relationship between the throttle lever and the handle-engaging member (showing a state in which the mount base is disengaged from the handle-engaging member) of the handling device shown in FIG. 9.

As shown in FIG. 10, the actuating arm portion 40*b*' is provided with a curved recessed portion 40*d*', the inner wall of which is adapted to be contacted by the actuating portion 25*c*' of the throttle lever 25'. Namely, when the throttle lever 25' is rotated, the actuating portion 25*c*' is caused to move up and down while contacting the inner wall of the curved recessed portion 40*d*', thus causing the lower portion of the handle-engaging member 40' to swing in the longitudinal direction.

An engaging projection 40*f*' is formed as an engaging member on the right side plate 40*e*' of the actuating arm portion 40*b*' so as to face and extend toward the engaging pawl 25*e*'.

Figure 11:
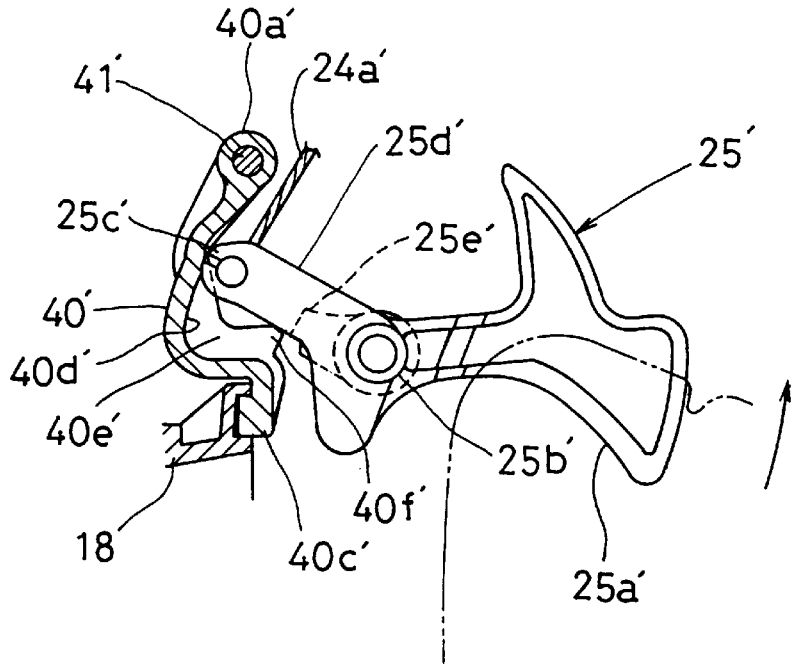
FIG. 11 is a partially sectioned side view illustrating an operational relationship between the throttle lever and the handle-engaging member (showing a state in which the mount base is engaged with the handle-engaging member, and the throttle lever is not manipulated) of the handling device shown in FIG. 9.
Figure 12:
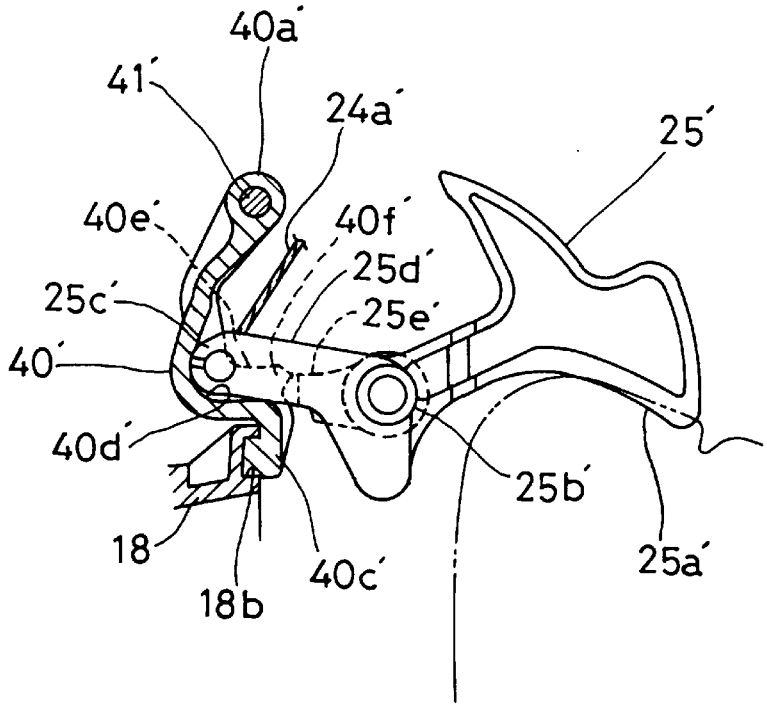
FIG. 12 is a partially sectioned side view illustrating an operational relationship between the throttle lever and the handle-engaging member (showing a state in which the mount base is engaged with the handle-engaging member, and the throttle lever is fully manipulated) of the handling device shown in FIG. 9.

FIGS. 10 to 12 illustrate the operational relationships between the throttle lever 25' and the handle-engaging member 40' of the handling device according to the second embodiment of this invention.

FIG. 10 shows a case in which the movable serration 40*c*' of the handle-engaging member 40' and the stationary serration 18*b* of the cylindrical receiver 18 are misaligned to each other, so that the ridge of one serration contacts a ridge of the other, i.e. FIG. 10 shows a state where the actuating portion 25*c*' of the throttle lever 25' is rendered in a non-rotatable condition.

Since the movable serration 40*c*' of the handle-engaging member 40' is not engaged with the stationary serration 18*b* of the cylindrical receiver 18 under this non-rotatable condition, the handle-engaging member 40' is kept rotated rearwardly about the axial line J—J of the supporting axis 41'. Therefore, even if the manipulating portion 25*a* of the throttle lever 25' is manipulated to rotate upward so as to move the actuating rod 25*d*' downward, a further rotation of the actuating rod 25*d*' is prevented, since the engaging projection 40*f*' of the handle-engaging member 40' is impinged upon or engaged with the engaging pawl 25*e*' of the throttle lever 25'.

Due to this engagement between the engaging projection 40*f*' and the engaging pawl 25*e*', it is not possible for the actuating portion 25*c*' to strongly press the upper portion of the curved recessed portion 40*d*' of the handle-engaging member 40', thus preventing the actuating portion 25*c*' and/or the curved recessed portion 40*d*' from being distorted or fractured.

Further, since the contacting engagement (from the upward direction) of the engaging pawl 25*e*' with the engaging projection 40*f*' constitutes a downward force, the stress to move the handle-engaging member 40' in the forward direction is rather weak, and hence the stress imparted from the movable serration 40*c*' of the handle-engaging member 40' to the stationary serration 18*b* of the cylindrical receiver 18 is also weak. Therefore, there is little possibility that the serrations will be damaged.

FIGS. 11 and 12 show a case in which the movable serration 40*c*' of the handle-engaging member 40' is engaged with the stationary serration 18*b* of the cylindrical receiver 18, i.e. the ridges and roots of both serrations are properly engaged. Specifically, FIG. 11 illustrates a state where the actuating portion 25*c*' of the throttle lever 25' is initiated to rotate, and FIG. 12 shows a state where the rotation of the actuating portion 25*c*' of the throttle lever 25' has been completed. As shown in FIG. 11, since the movable serration 40*c*' of the handle-engaging member 40' is engaged with the stationary serration 18*b* of the cylindrical receiver 18 and the handle-engaging member 40' is kept rotated forward, the engaging pawl 25*e*' of the throttle lever 25' is free to move downward without contact with the engaging projection 40*f*' of the handle-engaging member 40'. Ultimately, the engaging pawl 25*e*' is moved as shown in FIG. 12, so that the throttle cable 24*a*' is pulled in the direction to open the throttle valve CV and the opening degree of the throttle valve CV is adjusted.

As explained above, the handling device according to this second embodiment is designed to cope with the case wherein the correct engagement between the movable serration 40*c*' of the handle-engaging member 40' and the stationary serration 18*b* of the cylindrical receiver 18 is prevented because of misalignment of the two serrations, and hence is featured in that the rotation of the throttle lever 25' is restricted in such case so as to prevent the upper portion of the curved recessed portion 40*d*' of handle-engaging member 40' from being forcibly pushed by the actuating portion 25*c*', thus avoiding distortion or fracturing of the actuating portion 25*c*' and the curved recessed portion 40*d*'.

Further, when the movable serration 40*c*' of the handle-engaging member 40' and the stationary serration 18*b* of the cylindrical receiver 18 are misaligned with each other, the rotation of the throttle lever 25' is restricted, so that the throttle cable 24*a*' is prevented from being pulled, and hence the revolution speed of the internal combustion engine 11 can be kept in a state of idling and the clipper blades 13*a* and 13*b* are prevented from being inadvertently actuated (reciprocating movement).

As seen from the above explanations, since the handling device of this invention is provided with a handle engaging portion and an engaging member's rotation-regulating mechanism, the handling device can be easily engaged with the mount base and, at the same time, the working portion can be prevented from being inadvertently actuated at the moment of release of the engagement of the handling device from the mount base.

Further, once the mount base is engaged with the rear handle portion, the two portions can be automatically locked to each other, so that it is made impossible to release the engagement therebetween unless the latch knob of the engaging member's rotation-regulating mechanism is intentionally pushed. Thus, it is possible to ensure the maintenance of engagement between the mount base and the rear handle portion, as well as to ensure safety at the moment of releasing the engagement therebetween.

Furthermore, the handling device according to this invention is designed to automatically restrict rotation of the throttle lever whenever the serration of the mount base and the serration of the rear handle are misaligned to each other, thereby preventing these manipulating members from being distorted or fractured.

What is claimed is:

1. A power working machine, comprising a prime mover;

a mount base carrying the prime mover;

a working portion coupled to the prime mover; and a handling device rotatably attached to the mount base, the handling device including a case member, a control lever rotatably attached to the case member and coupled to a control member of the prime mover, and a handle-engaging member mounted on the case member and normally biased to a first position free of engagement with the mount base so as to permit rotation of the handling device relative to the mount base and movable against the bias to a second position in engagement with the mount base so as to lock the handling device against rotation relative to the mount base, the handle-engaging member being coupled to the control member so as to be moved from the first position to the second position upon a rotating movement of the control lever from a first position to a second position.

2. The working machine according to claim 1, wherein the control lever includes a manipulating portion adapted to be manipulated by a finger, a pivot portion constituting the center of rotation of the control lever, and an actuating arm having at a distal end thereof remote from the pivot portion an actuating portion, and wherein the handle-engaging member is rotated by engagement of the actuating portion with the handle-engaging member so as to be moved into engagement with the mount base.

3. The working machine according to claim 2, wherein the handle-engaging member is moveable in rotation and includes a pivot portion constituting the center of rotation of the handle-engaging member, an actuating arm portion extending outwardly in the radial direction from the pivot portion, and a movable serration which is integrally formed at a distal end of the actuating arm portion and engages a stationary serration formed circularly on the mount base when the handle-engaging member is in the second position.

4. The working machine according to claim 3, wherein the actuating arm portion of the handle-engaging member is provided with a curved recessed portion, a wall of the curved recessed portion being contacted by the actuating portion of the control lever so as to rotate the handle-engaging member upon rotation of the control lever.

5. The working machine according to claim 2, wherein the control lever has an engaging pawl extending toward the handle-engaging member, and the handle-engaging member has an engaging portion, the engaging pawl and the engaging portion being arranged to contact with each other upon rotation of the control lever away from the first position in a rotating manipulation of the control lever under a condition in which the handle-engaging member is prevented from moving from the first position to the second position and being arranged so as to not contact each other under a condition in which the handle-engaging member is able to rotate from the first position to the second position so as to allow a movable serration at the distal end of the actuating arm to be engaged with a stationary serration of the mount base.

6. The working machine according to claim 1, further comprising a safety-latch mechanism received in the case member and normally engaging the handle-engaging member so as to maintain the handle-engaging member in the second position in engagement with the mount base regardless of the position of the control lever and manually operable to disengage from the handle-engaging member and permit the handle-engaging member to move from the second position to the first position.

7. The working machine according to claim 6, wherein the safety-latch mechanism includes a latch body secured to the case member, a latch shaft slidably inserted into the latch body and provided at one end thereof with an enlarged flange portion, a latch knob formed at the other end of the latch shaft, and a compression coil spring which is interposed between the latch body and the latch knob.

8. The working machine according to claim 7, wherein the safety-latch mechanism is arranged such that the rotation of the handle-engaging member out of the second position is prevented when an outer circumferential wall of the enlarged flange portion is contacted with an end face of an actuating arm portion of the handle-engaging member and the handle-engaging member is allowed to rotate from the second position to the first position when the outer circumferential wall of the enlarged flange portion is prevented from engaging a surface of the actuating arm portion by manual depression of the latch by a user's finger.

* * * * *